US009046331B1

(12) United States Patent
Mallo

(10) Patent No.: US 9,046,331 B1
(45) Date of Patent: Jun. 2, 2015

(54) BROADHEAD

(71) Applicant: Jorge E Mallo, Miami Shores, FL (US)

(72) Inventor: Jorge E Mallo, Miami Shores, FL (US)

( * ) Notice: Subject to any disclaimer, the term of this patent is extended or adjusted under 35 U.S.C. 154(b) by 0 days.

(21) Appl. No.: 14/558,632

(22) Filed: Dec. 2, 2014

(51) Int. Cl.
*F42B 6/08* (2006.01)

(52) U.S. Cl.
CPC ..... *F42B 6/08* (2013.01)

(58) Field of Classification Search
CPC ..... F42B 6/08
USPC ..... 473/578, 582, 583, 584
See application file for complete search history.

(56) References Cited

U.S. PATENT DOCUMENTS

| | | | | | |
|---|---|---|---|---|---|
| 3,419,273 | A | * | 12/1968 | Rudzinski | 473/583 |
| 4,099,720 | A | * | 7/1978 | Zeren | 473/584 |
| 4,616,835 | A | * | 10/1986 | Trotter | 473/583 |
| 4,676,512 | A | * | 6/1987 | Simo | 473/584 |
| 4,940,246 | A | * | 7/1990 | Stagg | 473/583 |
| 4,986,550 | A | * | 1/1991 | Segovia | 473/584 |
| 4,998,738 | A | * | 3/1991 | Puckett | 473/583 |
| 5,078,407 | A | * | 1/1992 | Carlston et al. | 473/583 |
| 5,082,292 | A | * | 1/1992 | Puckett et al. | 473/583 |
| D330,404 | S | * | 10/1992 | Segovia | D22/115 |
| 5,160,148 | A | * | 11/1992 | Musacchia, Sr. | 473/584 |
| 5,172,916 | A | * | 12/1992 | Puckett | 473/583 |
| 5,178,399 | A | * | 1/1993 | Garoutte | 473/584 |
| RE34,397 | E | * | 10/1993 | DelMonte et al. | 473/584 |
| 5,257,809 | A | * | 11/1993 | Carrizosa | 473/584 |
| 5,458,341 | A | * | 10/1995 | Forrest et al. | 473/583 |
| 5,482,294 | A | * | 1/1996 | Sullivan et al. | 473/584 |
| D385,327 | S | * | 10/1997 | Delmonte | D22/115 |
| 5,879,252 | A | * | 3/1999 | Johnson | 473/583 |
| 6,077,179 | A | * | 6/2000 | Liechty, II | 473/582 |
| 6,128,983 | A | * | 10/2000 | Arnn | 81/460 |
| 6,165,086 | A | * | 12/2000 | Liechty, II | 473/583 |
| 6,171,206 | B1 | * | 1/2001 | Liechty, II | 473/583 |
| 6,174,252 | B1 | * | 1/2001 | Mizek | 473/583 |
| 6,258,000 | B1 | * | 7/2001 | Liechty, II | 473/583 |
| 6,319,161 | B1 | * | 11/2001 | Martinez et al. | 473/583 |
| 6,428,434 | B1 | * | 8/2002 | Liechty, II | 473/583 |
| 6,554,727 | B1 | * | 4/2003 | Armstrong et al. | 473/584 |
| 6,669,586 | B2 | * | 12/2003 | Barrie et al. | 473/583 |
| 6,695,726 | B1 | * | 2/2004 | Kuhn | 473/584 |
| 6,830,523 | B1 | * | 12/2004 | Kuhn | 473/583 |
| 6,887,172 | B2 | * | 5/2005 | Arasmith | 473/583 |
| 6,910,979 | B2 | * | 6/2005 | Barrie et al. | 473/583 |
| 6,935,976 | B1 | * | 8/2005 | Grace et al. | 473/583 |
| 6,942,588 | B2 | | 9/2005 | Barrie | |
| 6,966,856 | B1 | * | 11/2005 | Hajek | 473/583 |
| 7,037,222 | B2 | * | 5/2006 | Mizek et al. | 473/583 |
| 7,037,223 | B2 | * | 5/2006 | Kuhn | 473/583 |
| 7,182,706 | B2 | * | 2/2007 | Barrie | 473/584 |
| 7,771,298 | B2 | * | 8/2010 | Pulkrabek | 473/583 |
| 7,942,765 | B2 | * | 5/2011 | Odabachian et al. | 473/583 |
| 8,021,251 | B1 | * | 9/2011 | Ward | 473/583 |

(Continued)

FOREIGN PATENT DOCUMENTS

CA 2614446 A1 12/2008

*Primary Examiner* — Melba Bumgarner
*Assistant Examiner* — Alexander Niconovich
(74) *Attorney, Agent, or Firm* — Christopher J. Vandam, PA; Chris Vandam

(57) ABSTRACT

A broadhead tip for an arrow comprised of a plurality of blades affixed to a body. The blades are each on a distinct radii about a central axis. Each blade is a different distance from a tip of the broadhead. Upon impacting a target each blade sequentially impacts the surface of the target on a distinct radii about the central axis.

8 Claims, 3 Drawing Sheets

(56) References Cited

U.S. PATENT DOCUMENTS

| | | | | |
|---|---|---|---|---|
| 8,057,331 | B2 * | 11/2011 | Hudkins | 473/583 |
| 8,062,155 | B2 * | 11/2011 | Butcher | 473/582 |
| 8,113,974 | B1 * | 2/2012 | Ward, Jr. | 473/584 |
| 8,147,362 | B2 * | 4/2012 | Muntanion et al. | 473/584 |
| 8,167,748 | B2 * | 5/2012 | Butcher | 473/583 |
| 8,313,398 | B2 * | 11/2012 | Baker | 473/583 |
| D672,836 | S * | 12/2012 | Butcher | D22/107 |
| 8,393,983 | B1 * | 3/2013 | Sanford | 473/583 |
| RE44,144 | E * | 4/2013 | Barrie et al. | 473/583 |
| 8,512,179 | B2 | 8/2013 | Pulkrabek et al. | |
| 8,545,349 | B1 * | 10/2013 | Budris et al. | 473/583 |
| 8,926,457 | B2 * | 1/2015 | Treto | 473/583 |
| 2005/0153802 | A1 * | 7/2005 | Barrie | 473/584 |
| 2009/0111621 | A1 * | 4/2009 | Mizek | 473/584 |

* cited by examiner

BROADHEAD

BACKGROUND OF THE INVENTION

1. Field of the Invention

The present invention relates to archery hunting, and more particularly, to a broadhead tip for an arrow or bolt.

2. Description of the Related Art

Several designs for arrow heads have been designed in the past. None of them, however, includes a broadhead tip where each of the blades of the broadhead enter the game sequentially with a partial asymmetric blade configuration.

Applicant believes that the closest reference corresponds to U.S. Pat. No. 4,616,835 issued to Trotter. However, it differs from the present invention because the Trotter design, like all other known designs, arranges the blades of a broadhead symmetrically about the central axis of the broadhead and arrow shaft.

Specifically, Trotter shows in a primary embodiment that there are a pair of symmetrical delta shape blades. The forward blade strikes the game at the forward most point of the broadhead and both projecting symmetrical wings of the blade enter simultaneously. Trotter has a second delta blade that is offset ninety degrees and it too has both wings enter simultaneously on each side of the arrow shaft.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a hunting broadhead that creates a wider wound channel.

It is another object of this invention to provide a hunting broadhead that creates a deeper penetrating wound.

It is still another object of the present invention to provide a hunting broadhead that rapidly exsanguinates game resulting in a more humane kill.

Another object of the invention is to provide a more devastating broadhead that reduces the likelihood of wounded game running distances resulting in chases or lost game.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
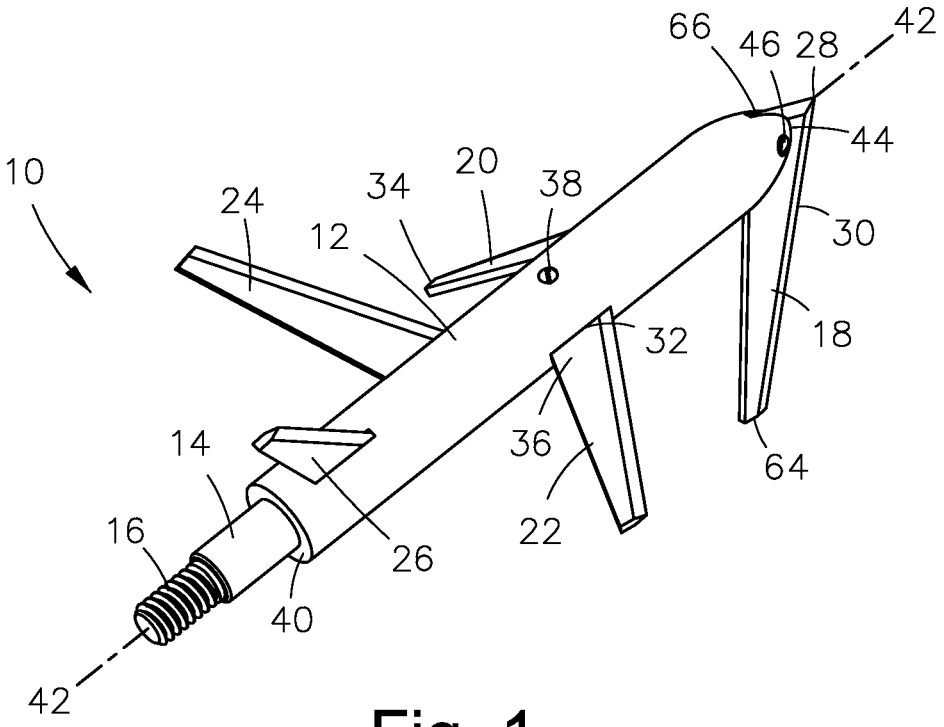
FIG. 1 represents a perspective view of a version of a broadhead tip.

Archery and the related arts have been used by mankind for thousands of years. In its traditional form a flexible and strong bow with a string is used with an arrow. An arrow typically includes fletching at an aft end with a sharp point at the forward end. The sharp point has been made from carved wood or bamboo, flakes of stone and metal.

It its modern form, arrows are made from modern and historic type materials. Fletchings are often made of feather-like plastic affixed to a carbon fiber or aluminum shaft. At the forward tip of the shaft is a threaded ferrule that can accept a variety of arrow tips. The aft tip of the arrow typically has a nock that fits the string of the bow to which the arrow is matched.

A wide variety of arrow tips are commercially available from sporting goods suppliers. A metal field point is a common utility tip. Other tips for target shooting, smaller game, fishing and other applications are readily available.

The terms broadhead, arrow, tip and related terms apply to a commonly understood bow and arrow combination. However, it should be understood that the present device can be equally suitable for crossbow and bolt combination. Other hunting and shooting applications can well fall within the scope of the present invention such as other projectile type weapons like an atlatl, spear or analogous device.

One of the most common types of arrow tips is generally classified as a broadhead. Looking now at FIG. 4 where an example of a prior art arrow tip is shown to include, among other features, a blade 68, a blade 70, a tip 72, a body 74 and a dimension 76.

These tips have a plurality of blades such as the blade 68 and blade 70 in the example. Some may have two blades, four blades or more. The prior art consistently balances an opposed pair of blades, 68 and 70, affixed to a body and centered about a tip 72. The total wingspan of the tip in FIG. 4 is shown as dimension 76.

Figure 4:
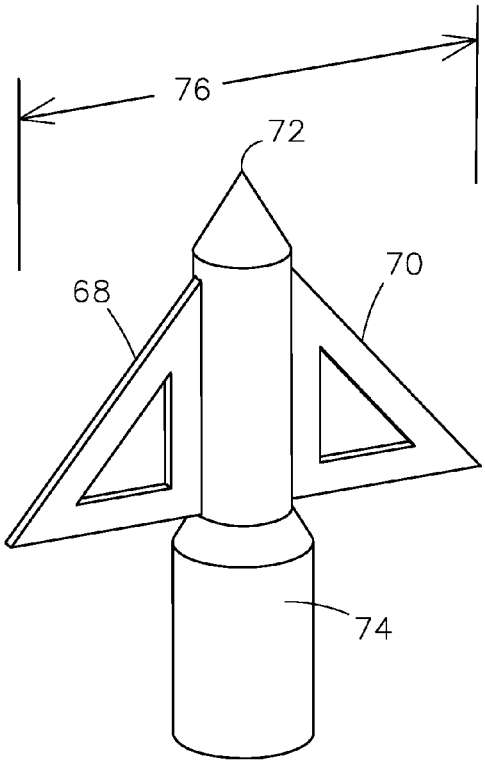
Fig. 4 PRIOR ART
FIG. 4 is a representation of a prior art design.

In typical use, the arrow with a tip affixed similar to that shown in FIG. 4 is shot at a target. The tip 72 strikes and penetrates the target. Immediately following are the blades 68 and 70. The blades 68 and 70 simultaneously enter the target on each side of the tip creating an entrance hole the width of dimension 76.

In practice, the maximum effective measurement of dimension 76 is about six centimeters for prior art tip styles, such as that demonstrated in FIG. 4. Factors such as the number of blades, weight of the tip and arrow and draw strength of the bow can affect the optimal measurement of dimension 76 so that it may be a couple of centimeters smaller or larger for some applications.

It can be appreciated by hunters of all stripes that a quick hunting kill is preferred. This is true from a humane perspective to reduce animal suffering by rapid exsanguination. It is also to the benefit of the hunter to avoid mere injury to the animal where it might initially run and become lost to the hunter. For at least these reasons, a deeper and wider wound channel is preferred.

Many game animals have a tough hide. As a tip of an arrow strikes an animal a significant portion of the kinetic energy is expended in piercing the fur and skin. A quick kill requires deep penetration and wide wound channel. The prior art is significantly limited because of the symmetrical blades 68 and 70 entering the skin simultaneously on each side of the tip 72.

The prior art has struck a balance between the width of the wound channel, dimension 76 and the depth that the arrow and tip can penetrate into the body. The greater the dimension 76, the shallower a given combination of bow and arrow will penetrate into the flesh of the animal hunted. A shallower depth of penetration is less likely to hit vital organs and so is disfavored in many situations.

An important aspect of a principal version of the present broadhead design is that each blade on the broadhead enters the prey individually. As the broadhead strikes the hide of the animal the entire kinetic force of the arrow and broadhead combination is applied to one blade at a time as it enters the animal. As soon as one blade passes through the skin then the second blade follows. One blade at a time slices through the tough skin thereby preserving as much kinetic energy as possible for a deep penetration of the broadhead.

Figure 5:
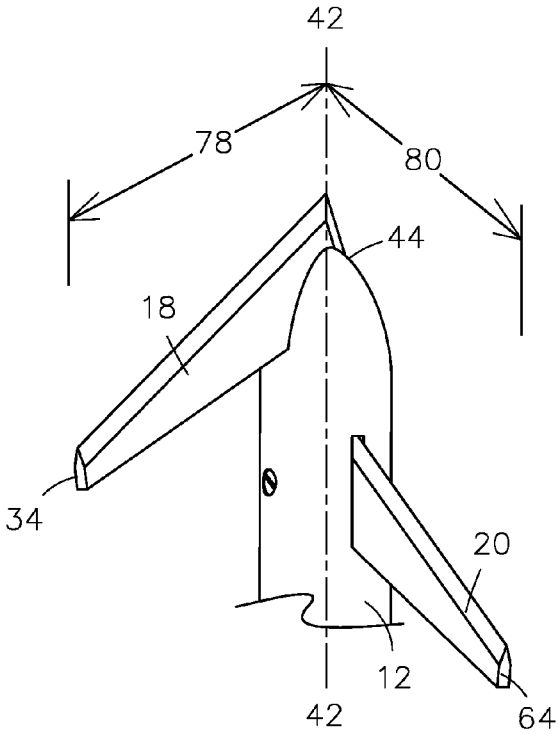
FIG. 5 is a perspective partial view of a version of a broadhead.

Referring to FIG. 5 where a partial perspective view of a broadhead tip is shown that is similar in some respects to the version of a broadhead tip shown in FIG. 1 and that further includes a dimension 78 and dimension 80. Dimension 78 is substantially similar to the length of the blade 20 from the tip 34 to the axis 42. Similarly, dimension 80 is about the same as the distance from the tip 64 of the blade 18 to the axis 42 of the body 12.

The dimension 76 in the prior art is analogous to the sum of dimensions 78, dimension 80 and the complimentary dimensions of any additional blades that may be included in the broadhead. Obviously, the wound channel for a prior art broadhead as in FIG. 4 would be generally linear where the wound channel of only the blades 18 and 20 of the partial example in FIG. 5 would be somewhat "V" shaped depending on the angle between the blades 18 and 20. Additional blades about the axis 42 would add further wound channels emanating and radiating from about the central axis 42.

The dimension 78 of blade 20 in a version of the present design in FIG. 5 can be nearly as long as the dimension 76 in the prior art in FIG. 4. As the current broadhead further penetrates, dimension 80 of blade 18 increases the sum length of the wound channel, nearly doubling the overall width of the wound channel.

Figure 2:
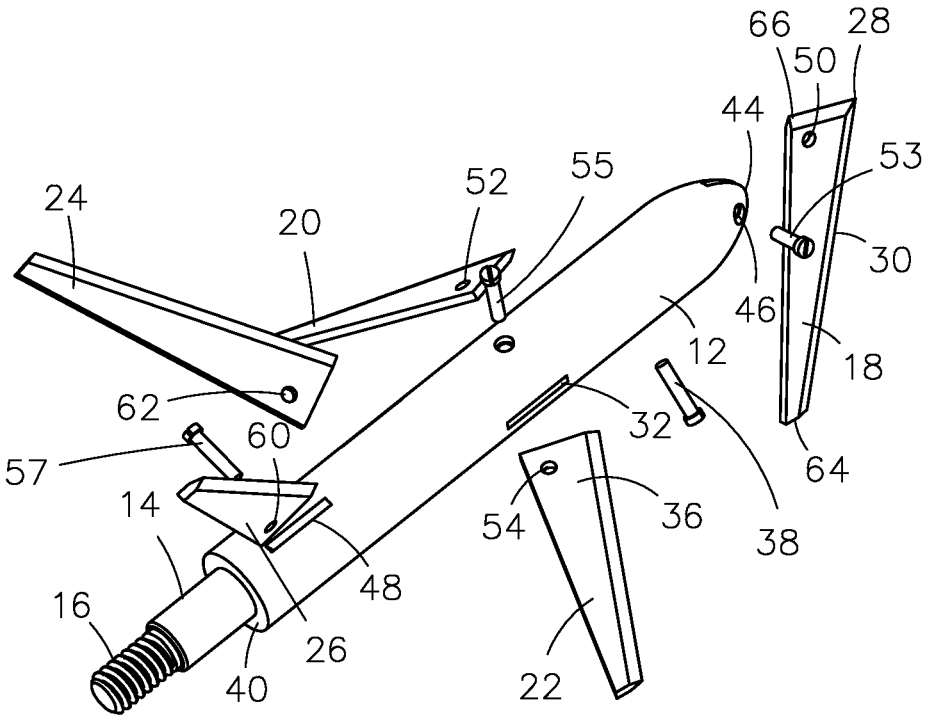
FIG. 2 shows an exploded perspective view of a broadhead similar to that shown in FIG. 1.
Figure 3:
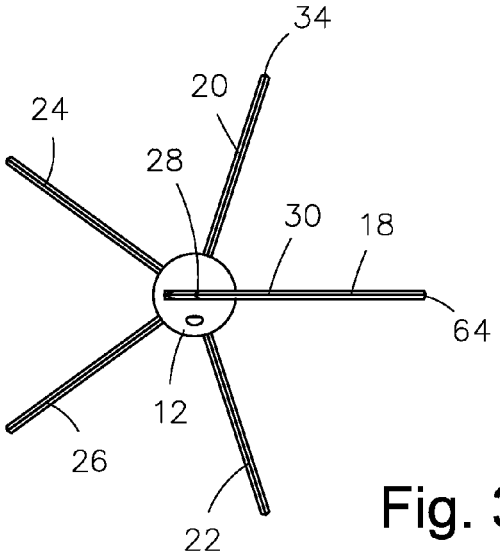
FIG. 3 illustrates an elevation view of a tip of a broadhead.

Referring now to the drawings in FIGS. 1 through 3, where versions of the present invention are generally referred to with numeral 10, it can be observed that it basically includes a body 12, a guide 14, threads 16, a blade 18, a blade 20, a blade 22, a blade 24, a blade 26, a tip 28, an edge 30, a slot 32, a tip 34, a base 36, a lock 38, a seat 40, an axis 42, a nose 44, a lock 46, a slot 48, an aperture 50, an aperture 52, a pin 53, an aperture 54, a pin 55, a lock 56, a pin 57, a lock 58, an aperture 60, a aperture 62, a tip 64 and a tip 66.

The body 12 is the central structure of the arrow head around which the other several components are situated. In some versions the body 12 is cylindrical in general shape but this is not required. Some other versions (not shown in the drawings) may have an oval or polygonal cross section. For example, a four bladed body could have a rectangular cross section, a five bladed version could have a pentagonal cross section where a six bladed version could have a hexagonal cross section. The number of sides of a polygonal cross section does not necessarily correspond to the number of blades affixed to the body.

Arrow shafts are often purchased, stored and transported separate from a corresponding broadhead. Therefore, the broadhead, in most iterations, is separable from the arrow shaft. The female threaded ferrule at the forward tip of the arrow shaft fits over the male thread 16 and guide 14 of the broadhead tip. The forward edge of the ferrule tightly fits against the seat 40 ensuring an aligned and secure fit of the broadhead onto the arrow shaft.

For reference, an imaginary axis 42 is shown to demonstrate the centerline of the body 12. Generally, the axis 42 is coincidental to a centerline of the arrow shaft.

A key to the present device is a plurality of blades that are attached to the body that radiate about the axis at predetermined fixed angles from each other and each at a predetermined location along the axis 42 between the tip 66 and the seat 40.

The examples shown in FIGS. 1, 2 and 3 are similar. FIG. 1 shows a complete broadhead dissociated from an arrow shaft. FIG. 2 shows the same arrow head with blades and locks removed. FIG. 3 is a head on view demonstrating, among other features, the spacing of the blades 18, 20, 22, 24 and 26 about the body 12.

In this example, the five blades shown to be in the order of 20, 18, 22, 26 and 24. Each of these blades are equally space on radii about the axis 42. Where five blades are present and they are equally spaced there is about seventy-two degrees between the blades when viewed from the tip 28 as seen in FIG. 3. Each of the five blades in this example are positioned along the axis 42 at specifically varying lengths away from the nose 44. This feature allows each blade to individually and sequentially enter the surface of the target when shot.

Looking at FIG. 2 in particular, the blades 18, 20, 22, 24 and 26 are shown removed from the body 12 as they might be during maintenance, installation or removal of the blades. Each of the blades has a corresponding slot and lock.

Visible from the perspective view shown in FIG. 2 are the aperture 54 in blade 22 that correspond to and fit into slot 32. When the base 36 of the blade 22 is inserted into the slot 32 the pin 55 fits into the lock 38 and interacts with the aperture 54 to secure the blade 22 to the body. Removing the pin 55 from the lock 38 and therefore the aperture 54 in the blade 22 reverses the process and frees the blade 22 from the body 12 for maintenance or replacement.

One example of how a blade could lock onto the body 12 similar to that shown in FIG. 2 is that the pin 55 is thread or key at one end and has a tool end on the other. A tool end could be to mate with a slotted screwdriver, a Philips screwdriver, a hex key, a torx key or other available and known means. A mating thread or key would then be integrated into the lock 38. When the blade 22 is inserted into the slot 32 then the pin 55 can pierce the aperture 54 and thereby secure the blade 22 to the body 12 for use yet still be removable when needed.

It can be appreciated that the pin 55, lock 38 and aperture 54 combination are but one contemplated means of affixing a blade to the body while allowing its intentional removal. There may be other types of affixment means such as clips, screws, pins, snaps, frictional engagement, geometric locks or other means readily available in the art to connect a blade to a body.

Blade 26 may be similarly affixed to the body 12 at the slot 48 by means of the pin 57 through the aperture 60. Not seen entirely because of the orientation of the body 12 in FIG. 3, the blade 24 and blade 20 may be similarly attached to the body 12. Blade 20 having aperture 52 may also be similarly attached to the body 12.

Blade 18, in this embodiment of the device, is configured somewhat differently than other blades because blade 18 is at the forward end of the broadhead and traverses the nose 44. Blade 18 has a lead tip 28 connected to outboard tip 64 by the edge 30. A tip 66 is optionally present and if so preferably does not extend beyond the edge of the body or only minimally extends beyond the edge of the body. A slot with a pin 53 that interfaces with a lock 46 to secure the blade 18 to the body 12 through the aperture 50. The pin 53 and lock 46 may act similar to the other similarly named features that secure other blades to the body 12.

In a version of the device each of the blades are independently removable and replaceable. For example, if one blade is damaged it can be replaced to restore the broadhead to working order. The leading edges of the blades can have differing geometries, for instance a double or single bevel. Serrations may also optionally be formed into the leading edges of any of the blades.

In at least one version of the device the blades are fixed and cannot be removed or otherwise separated from the body 12. In such a version the blades may be formed of the same material as the body 12. Alternatively the blades could be riveted, soldered or otherwise affixed to the blade. This version could be more economical to manufacture and could be considered a disposable version.

Figure 6:
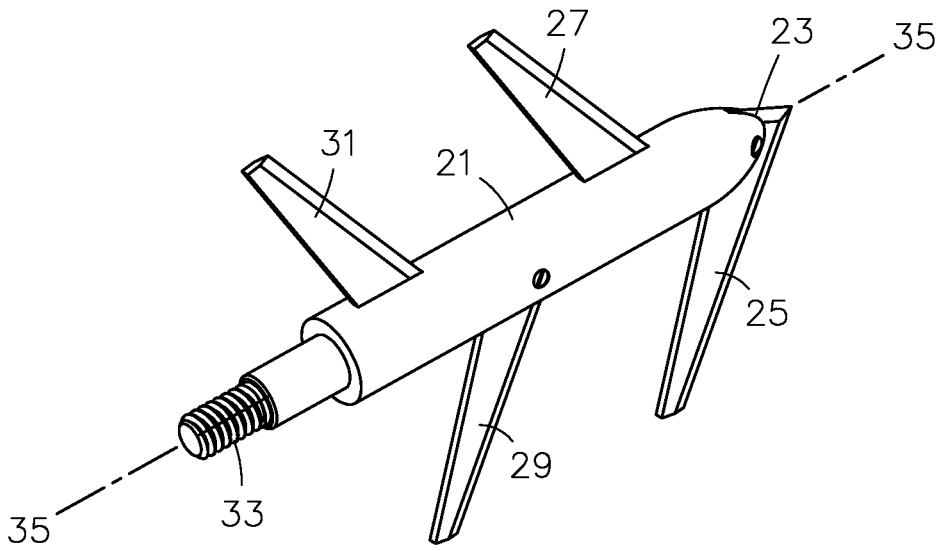
FIG. 6 is a perspective view of a broadhead.

FIG. 6 shows a perspective view of a version of a broadhead tip that includes, among other features, a body 21, a tip 23, a blade 25, a blade 27, a blade 29, a blade 31, threads 33 and axis 35.

In this example seen in FIG. 6 the blades 25, 27, 29 and 31 are all coplanar and radiate about body 21. The blades are positioned along the axis 35 sequentially from the tip 23 so that when impacting a target blade 25 completely penetrates the surface of the target before blade 27 strikes the surface. In turn, blade 27 passes though the surface of the target before blade 29 strikes the surface. Likewise, blade 31 lastly strikes the target surface after blade 29 has penetrated the surface. In this fashion only one blade at a time is passing through the surface of the target and yet the wound channel is the full wingspan of combination of all the blades present.

FIG. 6 shows four blades but this is not the only number. Also effective could be as low as about two or as many as about eight blades. In some narrow applications it is possible to have many more blades but typically the distance between the blade tip and the axis 35 would be reduced if over eight blades are present in a configuration similar to that seen in FIG. 6.

Figure 7:
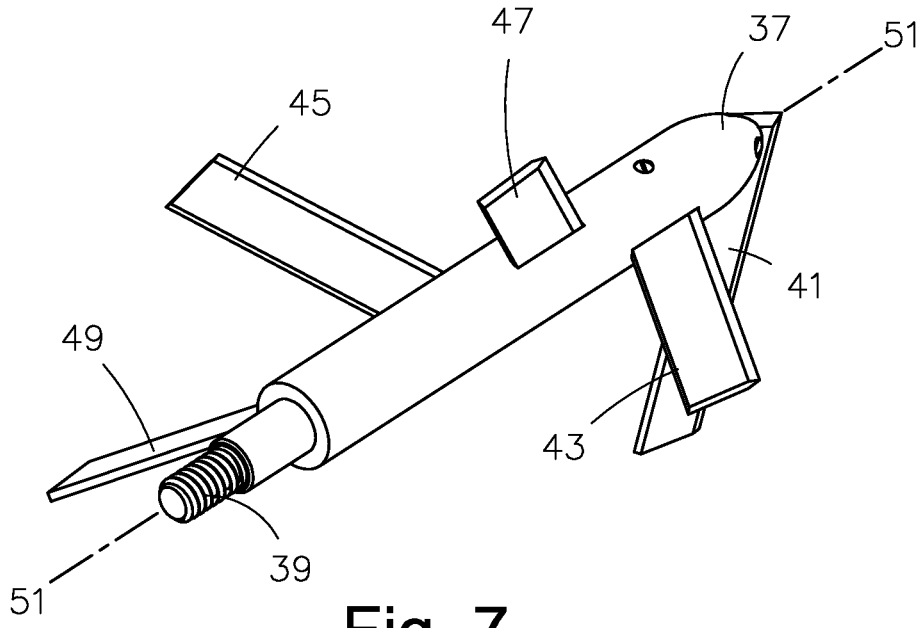
FIG. 7 is a perspective view of a broadhead.

FIG. 7 is another example of a variant of a broadhead tip that includes, among other elements, a body 37, threads 39, a blade 41, a blade 43, a blade 45, a blade 47, a blade 49 and an axis 51.

The version of the broadhead demonstrated in FIG. 7 is similar to that seen in FIG. 1 in several respects but with a variation on which radii about the axis 51 that the blades are affixed. In both FIGS. 1 and 7 there are five blades that are on radii about seventy two degrees apart about the axis 42 and 51 respectively. The difference is that in the version in FIG. 7 the blades sequentially from the forward end of the broadhead towards the aft end are on adjacent radii. Conversely, the example seen in FIG. 1 the radii on which the blades are affixed are not adjacent from the fore to the aft ends. Both versions, that in FIG. 1 and that in FIG. 7, are effective.

Each of the blades in FIG. 7 are parallel to the axis 51 so that resistance resulting from the blades during flight and during impact is minimized. Depending on the number and configuration of blades the energy lost, particularly upon impact, is detrimental to the severity of the potential wound by limiting the depth to which the broadhead will be able to penetrate.

Although not depicted in the drawings, any or all of the blades could have a camber to cause the broadhead, and the arrow shaft onto which it is attached, to rotate or spiral during flight about axis 51 imparting stability onto the combination. As noted above, a significant blade camber could affect the ability of the broadhead to penetrate and therefore lose some effectiveness.

It should be noted that any of the features in any of the several variations of the design could be implemented together and remain within the inventive concept.

The subject device and method of use is sometimes referred to as the device, the invention, the press, roller press, machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

A version of the device can be fairly described as a broadhead for an arrow (or bolt or other projectile weapon) comprised of a plurality of blades affixed to a body. The body has an imaginary line that is a central axis positioned between a forward end of the body and an aft end of the body and going all the way through the body as a reference line. Each blade is affixed to the body on a predetermined radii about one side of the central axis (an example is shown in FIG. 3, other blade orders are included). Each blade has a sharpened forward edge that slices when impacting the target. The sharpened forward edge of each blade is positioned at a predetermined unique distance from the forward end of the body so that upon impact each blade will individually penetrate the surface and each will penetrate in rapid succession.

The broadhead for can also optionally include that the radii on which the blades are affixed are angularly spaced equally about the central axis. For example, if there are four blades the angles between blades would each be ninety degrees. Similarly, if there are five blades then the angles between blades would each be seventy-two degrees. More or few blades would have equal degrees between them in this version similarly.

In another version, each blade is independently replaceable from the body. A mechanism such as the lock and pin shown in FIG. 2 is one example and other means to attach the blades to the body could be equally effective at securing the blades to the body during use yet allowing individual blade replacement.

Another version of the invention is shown in FIG. 6 where all of the blades are coplanar. More specifically, the face surface of all blades are on the same plane. This could be achieved with any number of blades although four are shown in FIG. 4.

In yet another version specifically within the inventive concept of the broadhead in that a face surface of all blades are parallel to the central axis. In other words, none of the blades have a camber that would cause the broadhead to twist or spiral in flight (as a rifled gun barrel would produce in a projectile). In other words in this version all of the blades are oriented so that the air resistance from the blades is minimized and the rotation imparted by the blades is also minimized. There may be some rotation derived from the fletching.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A broadhead for an arrow comprised of:

a plurality of blades affixed to a body;

the body has a central axis positioned between a forward end of the body and an aft end of the body;

each blade is affixed to the body on a predetermined unique radii about only one side of the central axis;

each blade has a sharpened forward edge;

the sharpened forward edge of each blade is positioned at a predetermined unique distance from the forward end of the body;

each successive blade is progressively a greater distance from the forward end of the body so that the sharpened forward edge of each blade completely passes through a surface of a target before the forward edge of a successive blade strikes the surface of the target.

2. The broadhead for an arrow as in claim 1 further characterized in that the radii on which the blades are affixed are angularly spaced equally about the central axis.

3. The broadhead for an arrow as in claim 1 further characterized in that each blade is independently replaceable from the body.

4. The broadhead for an arrow as in claim 1 further characterized in that a face surface of all blades are parallel to the central axis.

5. A broadhead for an arrow comprised of:

a plurality of blades affixed to a body;

the body has a central axis positioned between a forward end of the body and an aft end of the body;

each blade is affixed to the body on a predetermined unique radii about only one side of the central axis;

each blade has a sharpened forward edge;

the sharpened forward edge of each blade is positioned at a predetermined unique distance from the forward end of the body;

each successive blade is progressively a greater distance from the forward end of the body so that the sharpened forward edge of each blade completely passes through a surface of a target before the forward edge of a successive blade strikes the surface of the target; and a leading blade has a sharpened forward edge that traverses the central axis at the forward end of the body.

6. The broadhead for an arrow as in claim 5 further characterized in that the radii on which the blades are affixed are angularly spaced equally about the central axis.

7. The broadhead for an arrow as in claim 5 further characterized in that each blade is independently replaceable from the body.

8. The broadhead for an arrow as in claim 5 further characterized in that a face surface of all blades are parallel to the central axis.

* * * * *